United States Patent [19]

Youngers et al.

[11] 4,217,001

[45] Aug. 12, 1980

[54] UNIVERSAL DIGGING BOOM

[75] Inventors: Stephen A. Youngers, Clearwater; Sidney B. Neufeld, Wichita, both of Kans.

[73] Assignee: J. I. Case Company, Racine, Wis.

[21] Appl. No.: 47,504

[22] Filed: Jun. 11, 1979

[51] Int. Cl.[3] ..... E21C 25/30; E02F 5/06

[52] U.S. Cl. ..... 299/82; 37/80 R; 37/191 A; 299/25; 299/36

[58] Field of Search ..... 299/25, 26, 36, 82, 299/83, 84; 37/80 R, 83, 84, 85, 86, 191 A, 192 A; 175/89, 90

[56] References Cited

U.S. PATENT DOCUMENTS

| | | | |
|---|---|---|---|
| 340,791 | 4/1886 | Lecher et al. | 299/82 X |
| 3,006,087 | 10/1961 | Lindell | 37/86 |
| 3,050,881 | 8/1962 | Brown | 299/83 X |

*Primary Examiner*—Ernest R. Purser

*Attorney, Agent, or Firm*—Cullen, Sloman, Cantor, Grauer, Scott & Rutherford

[57] ABSTRACT

A universal digging boom assembly is disclosed for attaching either a conventional type digging chain or a rock type digging chain for trenching operations. The boom assembly includes a box-like core section having upper and lower stiffening strips wherein each stiffening strip includes a plurality of embossments along its longitudinal extent. These embossments form mounting portions between the stiffening strips and the core section so that sprocket assemblies or channels may be attached to the boom assembly depending on the type digging chain being used. The digging boom also includes an attachment portion which permits the boom to be mounted on the trencher for both center and offset trenching operations. Other features include the sprocket assemblies and a rock chain channel which provide additional ease in the utilization of the various types of digging chains on the boom assembly.

8 Claims, 4 Drawing Figures

UNIVERSAL DIGGING BOOM

BACKGROUND OF THE INVENTION

The present invention relates to digging booms for trenching machines, and more particularly to an improved and simplified universal digging boom for attaching either a conventional digging chain or a rock and frost chain.

It is conventional in trenching operations to provide at least two different boom assemblies for the trenching machine. One of the boom assemblies is used for attaching a conventional digging chain with teeth for working in normal ground conditions. The other boom assembly supports and attaches a rock and frost chain with teeth for working in rough or hard ground. Changing from one boom assembly to the other is a problem because of the time and labor expended in the changeover.

The boom assemblies are heavy and awkward to manipulate, and it is difficult to connect the boom and chain to the drive train of the trenching machine. Further, after a period of use, dirt and corrosion often render removal of the boom assembly from the trencher quite difficult. Thus, there has been a need for a multipurpose boom assembly which can remain attached to the trencher and wherein both types of digging chains can be attached to it.

The disadvantages of conventional trencher digging booms have resulted in the present universal digging boom which attaches both conventional and rock type digging chains.

SUMMARY OF THE INVENTION

The universal digging boom of the present invention is particularly adapted to be mounted on a trencher, and it can be equipped with both sprockets and channels depending on the type digging chain to be used.

In the preferred embodiment, the universal digging boom includes a box-like core section with stiffening strips mounted to its top and bottom surfaces. A plurality of embossments along the longitudinal extents of the stiffening strips form mounting portions between the stiffening strips and the core section so that sprockets or channels may be attached to the boom. Thus, the boom is designed such that sprockets are attached thereto for the conventional digging chain or a combination of sprockets and a channel are attached thereto for a rock and frost digging chain. A conventional chain can also be used with the channel for those digging conditions that do not warrant a rock and frost chain but extra support for the chain is desirable.

The universal digging boom of the present invention also includes a unique attachment portion which permits the boom to be mounted on the trencher for center or offset trenching operations. The boom attachment portion includes L-shaped, parallel mounting plates fixed to the box-like core section and separated by a web. The mounting plates have protruding portions through which mounting holes are formed. The boom assembly may be converted from a center to an offset position by removing the mounting bolts, turning the boom over, remounting the boom assembly on an offset casting on the trencher, and replacing the mounting bolts. Thus, the attachment portion provides the boom additional versatility not previously available with conventional boom structures.

Other features of the present invention reside in the sprocket assemblies and rock chain channel. The sprocket assemblies permit the mounting of various sprockets having different diameters which accommodate digging chains of different strengths. The rock chain channel member is normally attached to the universal boom assembly when the rock digging chain is attached thereto, and it includes a T-shaped lip which guides and supports the rock chain during digging.

Other advantages and meritorious features of the universal digging boom will be more fully understood from the following description of the preferred embodiment, the appended claims, and the drawings, a brief description of which follows.

DESCRIPTION OF THE PREFERRED EMBODIMENT

Figure 1:
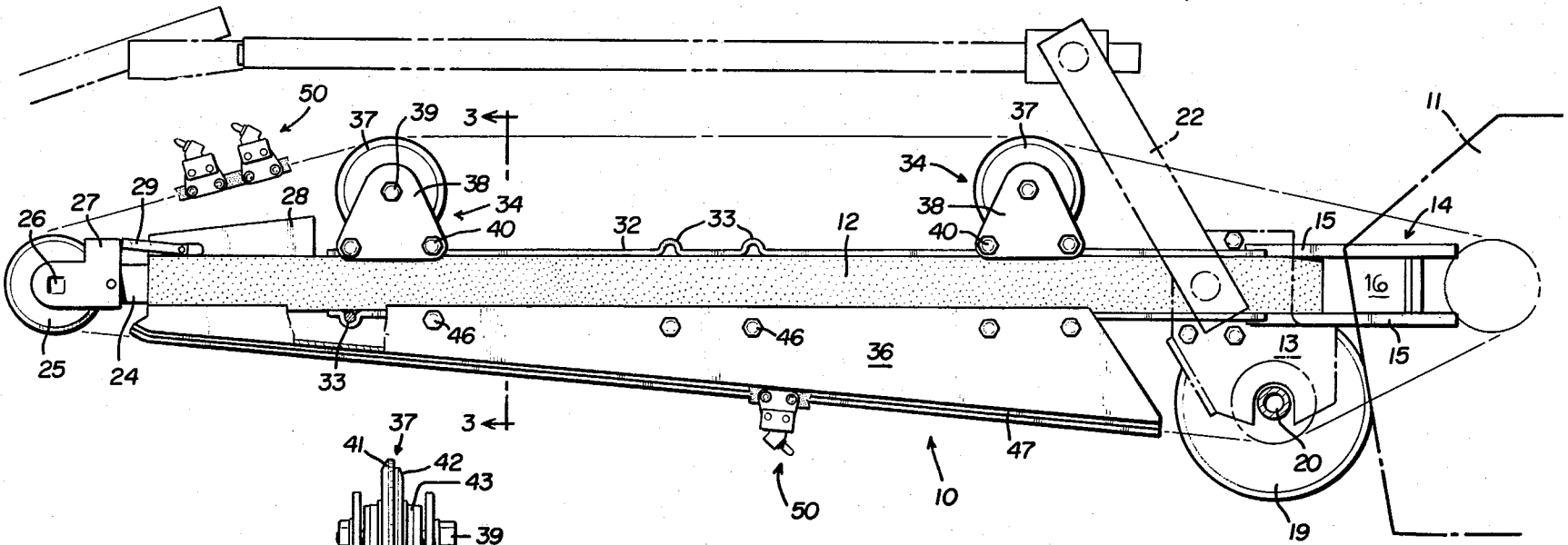
FIG. 1 is a side elevational view of the universal digging boom attached to a trencher and having a rock and frost digging chain mounted thereto.

A trencher having the universal digging boom according to the present invention is illustrated in FIGS. 1–4. The trencher 11 includes a rearwardly projecting universal digging boom 10 which is connected to the trencher 11 for pivotal movement. The digging boom is pivotally mounted in a cantilevered fashion above auger 19 which has a transverse shaft 20 journaled in bearing housing 13. The auger 19 disperses the spoil which is dug during the trenching operation to the sides of the trench.

The universal digging boom includes an elongated box-like core section 12 with an attachment portion 14 at one end thereof for mounting the boom to the trencher frame. The attachment portion 14 includes L-shaped parallel mounting plates 15 which are welded or otherwise secured to the box-like core section 12 and separated by a web 16. The mounting plates 15 have protruding portions through which mounting holes 18 are formed for the insertion of mounting bolts.

The boom assembly 10 may be converted from a center digging position (illustrated in FIGS. 1 and 2) to an offset digging position (not shown) by removing the mounting bolts (not shown) in holes 18, turning the boom over, re-mounting the boom assembly on an offset casting on the trencher (not shown), and replacing the mounting bolts. Thus, the attachment portion provides the boom additional versatility not available with conventional boom structures for converting from center to offset trenching operations.

Figure 2:
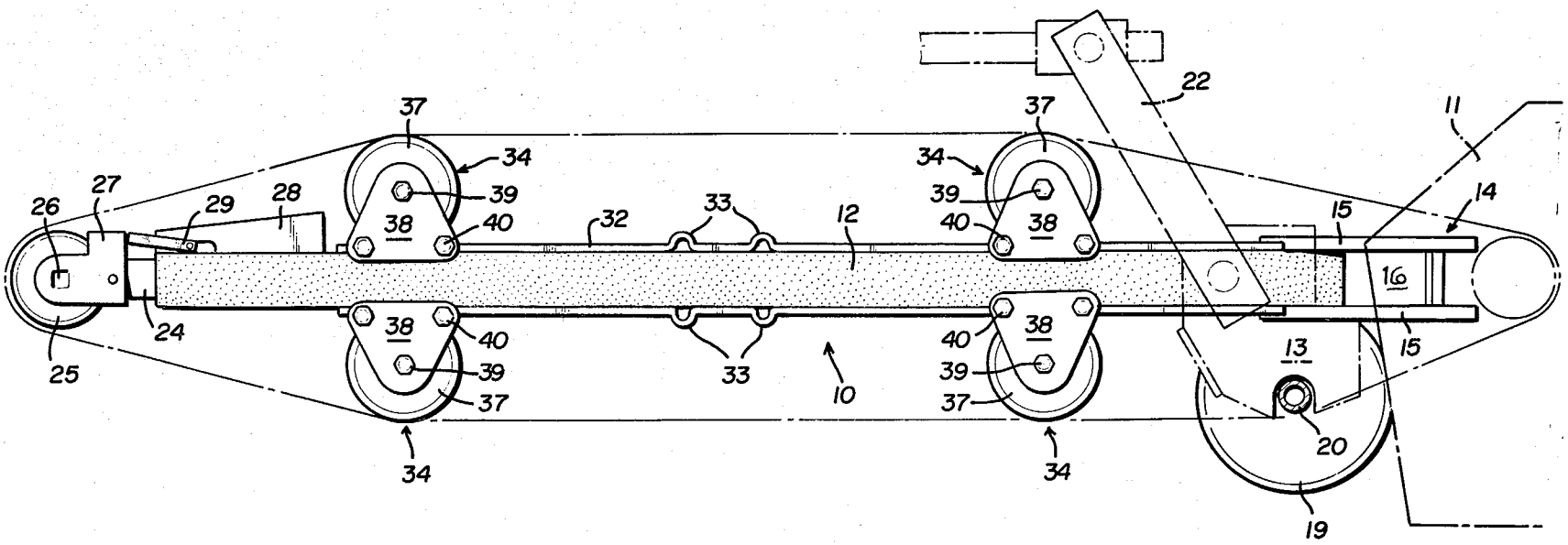
FIG. 2 is a side elevational view of the universal digging boom with a conventional type digging chain mounted thereto.

As illustrated in FIGS. 1 and 2, a crumber 22 is mounted to the box-like core section 12 to clean the bottom of the trench during the digging operation as is conventional.

A sprocket device including shaft 24 is telescoped into the open end of core 12. Sprocket 25 is rotatably mounted to bracket 27 on the end of shaft 24 by pivot pin 26. Locking bar 29 is attached at one end to bracket 27 and at its other end to bracket 28 and it prevents sprocket 25 from falling out of core 12 if the digging chain should break for any reason during the trenching operation and while the boom is extended downwardly into the trench.

The universal digging boom of the present invention can be equipped with both sprockets and channel members depending on the type digging chain to be used. The sprockets and channel members are attached to the boom structure by stiffening strips 32 which are welded or otherwise secured to the top and bottom surfaces of the box-like core 12. A plurality of pairs of U-shaped embossments 33 along the longitudinal extent of the stiffening strips form mounting portions between the stiffening strips 32 and core 12 so that sprockets or channel members may be attached thereto.

FIG. 1 illustrates the universal digging boom of the present invention with a rock and frost type digging chain 50 attached. Two sprocket assemblies 34 have been mounted to the top stiffening strip 32 of the boom assembly and a channel member 36 has been mounted to the bottom stiffening strip. Alternatively, FIG. 2 illustrates the universal digging boom with sprocket assemblies 34 attached to both the top and bottom stiffening strips. Thus, boom 10 permits both conventional and rock type digging chains to be attached thereto which significantly reduces the time and labor expended in making any changeovers.

Figure 3:
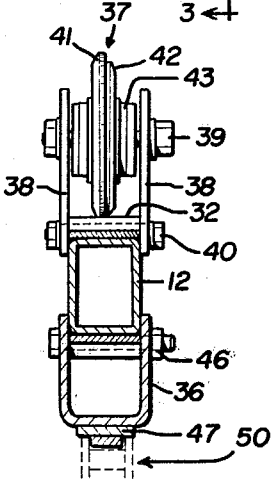
FIG. 3 is a cross-sectional view taken along line 3—3 in FIG. 1 which illustrates the sprocket assemblies and rock chain channel.
Figure 4:
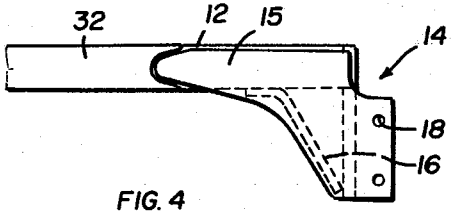
FIG. 4 is a partial top plan view illustrating the attachment portion of the boom assembly.

The sprocket assembly 34 for the universal digging boom 10 is best illustrated in FIG. 3. Each sprocket assembly includes spaced apart vertical leg portions 38 which are secured to U-shaped embossments 33 by bolts 40. Sprocket 37 and bearing 43 are rotatably mounted to the leg portions 38 by bolt 39. If it is desired to use different strengths of digging chain, sprocket 37 may be of various diameters as illustrated by 41 and 42 in FIG. 3. For example, a sprocket 37 having the diameter illustrated by 41 would be suitable for a chain having a greater strength, whereas a sprocket 37 having the diameter illustrated by 42 would be used for a lesser strength chain. Thus, the sprocket assembly permits the mounting of various sprockets having varying diameters which accommodate digging chains of different strengths.

The sprocket assembly is easily removed from the boom assembly when it is desired to make a changeover from the conventional to the rock type digging chain. The sprocket assembly is released from the boom assembly by removing the bolts 40 and 39 which allows the sprocket 37 to be removed for replacement with another sprocket or a channel member.

The channel member 36 which is used for the rock and frost type digging chain is illustrated in FIGS. 1 and 3. It is generally elongated and triangularly shaped having a U-shaped portion in cross-section which is mounted to the embossments 33 by bolts 46. A T-shaped lip portion 47 on the lower part of the channel 36 supports and guides the rock chain during digging. As illustrated in FIG. 3, the sides of the digging chain 50 slide along the T-shaped lip 47 and are supported against lateral movement by that portion of the lip between them. The channel 36 may be removed and replaced by sprocket assemblies 34 when using a conventional digging chain.

It will be apparent to those skilled in the art that the foregoing disclosure is exemplary in nature rather than limiting, the invention being limited only by the appended claims.

We claim:

1. A universal digging boom assembly which is adapted for mounting various types of digging chains, said boom assembly including an elongated, box-like core portion having a hollow first end for telescopically receiving a sprocket means, said sprocket means being engageable with a digging chain entrained around said core portion, attachment means mounted to a second end of said core portion for mounting said boom assembly to a vehicle, stiffening strips mounted to said core portion, said stiffening strips being elongated and generally rectangular in plan view, each said stiffening strip having a plurality of embossments along its longitudinal extent, said embossments forming mounting portions between said stiffening strips and said core portion which permit mounting a plurality of interchangeable chain supporting means, said plurality of interchangeable chain supporting means being mounted to said mounting portions for attaching, supporting, and guiding said digging chain, said supporting means being removable and replaceable with other supporting means depending on the type digging chain being used without removing said boom assembly from said vehicle.

2. The universal digging boom assembly as defined in claim 1 wherein said mounting portions are formed in pairs along the longitudinal extents. of said stiffening strips.

3. The universal digging boom assembly as defined in claim 2 wherein said supporting means include a plurality of sprocket assemblies and at least one channel member which are mounted to said mounting portions, said channel member being elongated and generally triangularly shaped and having a U-shaped portion which is mounted to said mounting portions.

4. The universal digging boom assembly as defined in claim 3 wherein said channel member having a T-shaped lip portion for supporting and guiding said digging chain.

5. The universal digging boom assembly as defined in claim 2 wherein said supporting means includes a plurality of sprocket assemblies which are mounted to said mounting portions, each said sprocket assembly including spaced apart vertical leg portions which are releasably mounted to said mounting portions and a replaceable sprocket rotatably supported between said leg portions.

6. The universal digging boom assembly as defined in claim 1 wherein said attachment portion includes L-shaped, parallel mounting plates fixed to said core section and separated by a web portion, said mounting plates having protruding portions with mounting holes therein, said attachment portion permitting said boom assembly to be mounted for either center or offset trenching operations.

7. The universal digging boom assembly as defined in claim 1 wherein said sprocket means includes a shaft which is telescoped in the hollow first end of said core portion, a bracket being mounted to said shaft and a sprocket rotatably mounted on said bracket, a locking bar being attached between said bracket on said shaft and a fixed bracket mounted to said core section to prevent said sprocket means from being removed from said core portion if said chain should break.

8. A universal digging boom assembly which is adapted for mounting either a first digging chain for normal ground conditions or a second digging chain for rock and frost ground conditions, said boom assembly including an elongated box-like core portion having top and bottom surfaces, said core portion including attachment means for mounting said boom assembly to a vehicle, stiffening strips being mounted to the top and bottom surfaces of said core portion, said stiffening strips being elongated and generally rectangular in plan view, each said stiffening strip having a plurality of embossments along its longitudinal extent, said embossments forming mounting portions between said stiffening strips and said core portion, a first set of chain supporting means being mounted to said mounting portions for attaching said first digging chain to said universal digging boom assembly, said first set of supporting means comprising sprocket assemblies, said first set of supporting means being replaceable with a second set of chain supporting means, said second set of supporting means being mounted to said mounting portions for attaching said second digging chain, and said second set of supporting means comprising sprocket assemblies and a channel member.

* * * * *